United States Patent [19]

Brinkmeier et al.

[11] Patent Number: 4,984,728

[45] Date of Patent: Jan. 15, 1991

[54] DUAL BELT CONVEYOR FOR MULTI-PLY CONTINUOUS PAPER TUBING

[75] Inventors: Friedhelm Brinkmeier, Lengerich; Horst Rautenberg, Lienen, both of Fed. Rep. of Germany

[73] Assignee: Windmoller & Holscher, Lengerich, Fed. Rep. of Germany

[21] Appl. No.: 300,987

[22] Filed: Jan. 24, 1989

[30] Foreign Application Priority Data

Feb. 2, 1988 [DE] Fed. Rep. of Germany ..... 3803058
May 26, 1988 [DE] Fed. Rep. of Germany ..... 3817928

[51] Int. Cl.[5] ..... B65H 20/00
[52] U.S. Cl. ..... 226/172; 226/4
[58] Field of Search ..... 226/4, 108, 111, 172, 226/195; 242/75.2

[56] References Cited

U.S. PATENT DOCUMENTS

| | | | |
|---|---|---|---|
| 3,761,003 | 9/1973 | Sieurin | 226/172 |
| 3,995,548 | 12/1976 | Mitter | 226/4 X |
| 4,034,904 | 7/1977 | Juditzhi | 226/172 X |
| 4,182,473 | 1/1980 | Mikulas | 226/195 X |
| 4,467,974 | 8/1984 | Crim | 242/752 X |
| 4,527,921 | 7/1985 | Koizumi et al. | 226/195 X |
| 4,598,329 | 7/1986 | Nelson | 226/195 X |

FOREIGN PATENT DOCUMENTS

| | | | |
|---|---|---|---|
| 0096223 | 12/1983 | European Pat. Off. . | |
| 2631723 | 1/1978 | Fed. Rep. of Germany | 226/172 |
| 0139323 | 3/1953 | Sweden | 226/172 |
| 0923405 | 4/1963 | United Kingdom | 226/172 |

*Primary Examiner*—Daniel P. Stodola
*Assistant Examiner*—Paul Thomas Bowen
*Attorney, Agent, or Firm*—Fleit, Jacobson, Cohn, Price, Holman & Stern

[57] ABSTRACT

In a dual belt conveyor for multi-ply continuous paper tubing having upper and lower endless conveyor belts between which the tubing is fed, turning point pulleys and backing rollers for the respective conveyor belts are longitudinally offset so that the tubing is moved through the conveyor along an undulating path. The inlet turning point pulley for the upper conveyor belt is positioned in front of the equivalent pulley for the lower conveyor belt so that the upper belt will contact the incoming tubing before the lower belt. A brake plate is provided under the inlet pulley of the upper belt over which plate the tubing is fed. The arrangement avoids the formation of undesirable waves and wrinkles in the tubing.

8 Claims, 1 Drawing Sheet

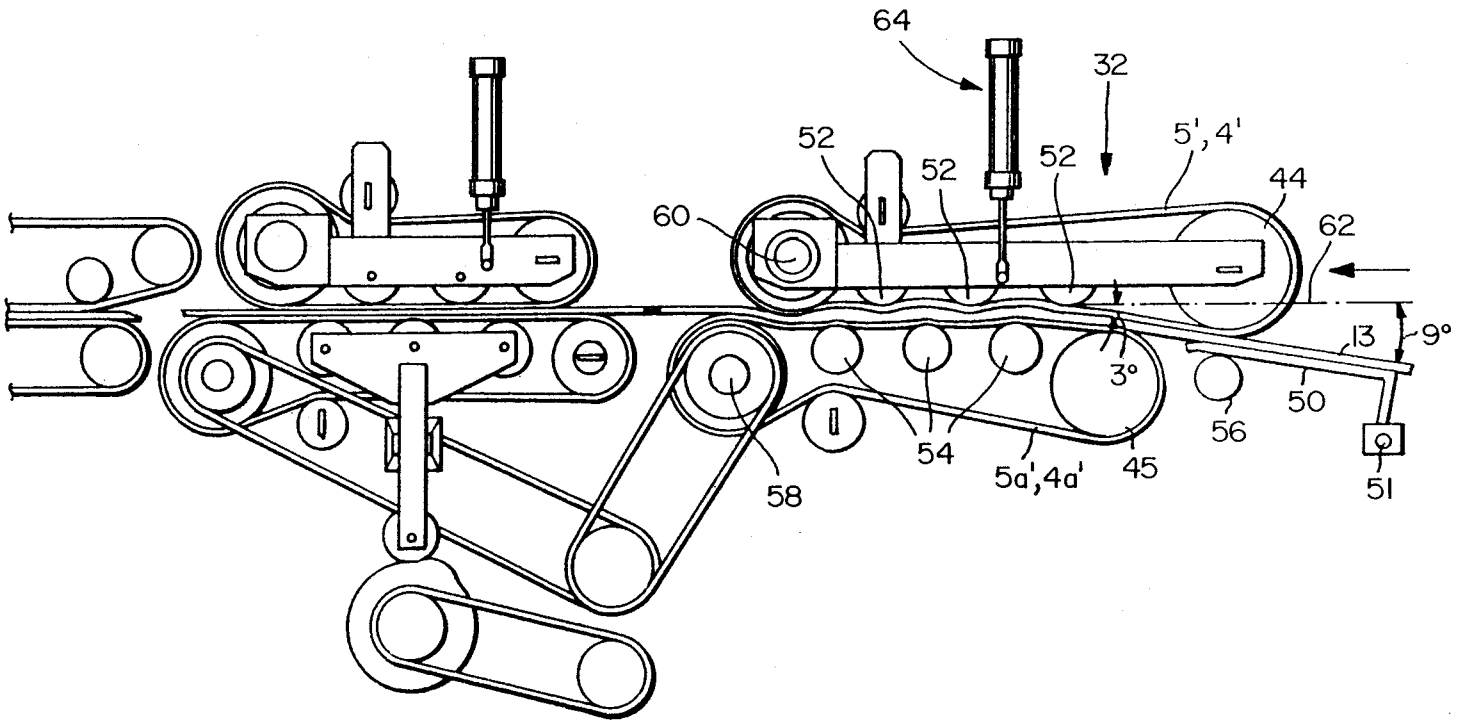
9°
51
13
50
56
62
44
5', 4'
32
52
52
52
64
60
3°
45
5a', 4a'
54
58

DUAL BELT CONVEYOR FOR MULTI-PLY CONTINUOUS PAPER TUBING

BACKGROUND OF THE INVENTION

1. Field of the Invention

This invention relates to a dual belt conveyor for continuous paper tubing which may have adhesive-bonded longitudinal seams in the middle portions of the upper plies, and which conveyor preferably precedes a tear-off dual belt conveyor moving at a higher speed serving to retain the last but one length section of the paper tubing, when a transverse perforation line at which the tubing is to be severed is disposed between the two dual belt conveyors, and wherein reversing pulleys and backing rollers for the conveyor belt or belts on the underside of the path of the continuous paper tubing are longitudinally offset from reversing pulleys and backing rollers on the upper side of said path, so that the paper tubing is moved through the dual belt conveyor along an undulating path.

2. Description of the Prior Art

In a dual belt conveyor as disclosed, for example, in European Patent No. 0 96 223, a wave may form in the top ply of the continuous paper tubing before the entry gap of the dual belt conveyor. The wave can be subsequently pulled into the nip of the conveyor and compressed by the belts so that sacks made from the paper tubing have a poor appearance and considerable difficulties can arise in further processing.

The formation of a wave before the entry gap of the dual belt conveyor is due to the fact that flat continuous paper tubing unwound from a roll may be somewhat longer at its edge portions than its intermediate portion. The difference in length may be about 1 mm per 1000 mm length of the continuous paper tubing.

SUMMARY OF THE INVENTION

It is an object of the invention to provide a dual belt conveyor of the kind described in which the formation of a wave in the continuous paper tubing forwardly of the entry gap of the conveyor will be substantially avoided.

In accordance with the invention, in a dual belt conveyor of the kind described, the rear reversing pulley or pulleys for the upper conveyor belt or belts are so arranged in front of the rear reversing pulley or pulleys for the lower conveyor belt or belts that the upper conveyor belt or belts will contact the incoming continuous paper tubing before the lower conveyor belt or belts. The paper tubing is drawn in not only by the upper conveyor belt or belts as the tubing is received by the conveyor and the upper conveyor belt or belts engage the top ply of the continuous paper tubing, but owing to the offset arrangement of the rear reversing pulleys there is no nip in which the continuous paper tube could be squeezed and which could cause an undesirable wave to be formed. The inlet turning point pulley is positioned to extend through a central plane of conveyance extending between the upper and lower conveyor belts.

A braking element which is movable into engagement with the rear reversing pulley or pulleys is suitably provided below the rear reversing pulley or pulleys and below the path for the continuous paper tubing. The lower plies of the tubing are braked by the braking element when the upper belts engage the upper paper ply. As a result, the upper ply is tensioned so that the formation of a wave is essentially prevented.

The braking element may consist of a pivoted sheet metal element or of a brake shoe and, for an adjustment of the braking force, may be movable into engagement with the rear reversing pulley or pulleys.

In order to subject the upper plies to a tension which will prevent the formation of a wave, the upper conveyor belt or belts may move at a higher speed than the lower conveyor belts. The speed difference may amount to about 0.2 to 0.3%.

Also, formation of a wave may additionally be prevented in that the continuous tubing is fed to the dual belt conveyor at an acute angle to the central plane of conveyance of the conveyor. Due to such feeding of the incoming tubing, it is bent about the lower rear reversing pulley so that the upper plies have a larger radius of curvature than the lower plies and the undesirable formation of a wave is thus further precluded.

BRIEF DESCRIPTION OF THE DRAWING

An illustrative embodiment of the invention will now be described more in detail with reference to the single drawing figure, which is a side elevation of a dual belt conveyor and a succeeding tear-off belt conveyor.

DESCRIPTION OF THE PREFERRED EMBODIMENT

A dual belt conveyor 32 as shown in the drawing has the same basic design as the dual belt conveyor described in European Patent No. 0 96 223 with reference to its FIG. 5 and the disclosure of EP 0 96 223 is accordingly expressly incorporated herein by reference including motors 58 and 60 for moving the upper belts at a higher speed than the lower belts. Hereinafter, only the differences and modifications between the respective conveyors will be explained and corresponding parts will be designated by the same references as in FIG. 5 of EP 0 96 223.

Rear reversing pulleys (inlet turning point pulleys) 44 and backing rolls 52 for upper belts 4', 5' of the dual belt conveyor 32 protrude rearwardly beyond reversing or inlet turning point pulleys 45 and backing rolls 54 for lower conveyor belts **4*a'*, 5*a'*. Thus, continuous paper tubing 13, entering in the direction of the arrow, will be contacted first by the upper conveyor belts 4', 5'. The offset of the reversing pulleys 44, 45 in the longitudinal direction should be sufficiently large that the continuous paper tubing 13 will not be squeezed in the direction of its thickness as it enters the dual belt conveyor 32 between the pulleys 44, 45**.

A braking element consisting of a sheet metal element 50 is disposed below the path for the continuous paper tubing and is pivoted to the machine frame on a pivot 51. The braking element extends, for example, at an angle of about 9 degrees to the central plane of conveyance 62. An eccentric supporting cam 56 is rotatably mounted in the machine frame in the region below the upper rear reversing pulleys 44 and is operable to urge the sheet metal element 50 against the reversing pulleys 44 under an adjustable pressure. An actuating drive for varying the pressure applied by a rotation of the eccentric supporting cam 56 is provided but is not shown.

Like the supporting cam 56, the rear reversing pulleys 44 are rotatably mounted on an adjustable eccentric shaft, not shown. As a result, the position of the supporting cam 56 and of the pulleys 44 may be changed, for example by piston cylinder assembly 64, in the same sense so that the angle of wrap of the tubing on the reversing pulleys 45 can be increased or decreased in such a manner in dependence on the material to be processed in dependence on the remaining instantaneous operating conditions that a formation of wrinkles can be avoided.

The feeding of the continuous paper tubing 13 is so controlled that the tubing runs up onto the lower reversing pulleys 45 with a downward inclination of, for example, 9 degrees to the central plane of conveyance 62. The configuration of the machine components is such that the continuous paper tubing is then so curved about the lower reversing pulleys 45 that the tubing has a downward inclination of, for example, 3 degrees to the central plane of conveyance as the tubing moves to the succeeding offset, following guide rollers for the upper belts.

What is claimed is:

1. A dual belt conveyor for continuous paper tubing comprising upper and lower endless conveyor belts between which the tubing is fed, said upper and lower endless conveyor belts extending substantially horizontally, turning point pulleys and backing rolls for the upper belts, the pulleys and backing rolls for the upper belt are offset lengthwise from the pulleys and backing rolls for the lower belt so that the tubing is moved through the conveyor along an undulating path, an inlet turning point pulley of the upper belt being positioned upstream of an inlet turning point pulley of the lower belt so that the upper belt contacts the tubing before the lower belt, said inlet turning point pulley being positioned to extend through a central plane of conveyance extending between said upper and lower endless conveyor belts, and means for feeding the continuous tubing to the conveyor with an inclination at an acute angle to the central plane of conveyance of the dual belt conveyor to initially contact the upper belt at said inlet turning point pulley at a location offset from the central plane of conveyance.

2. A dual belt conveyor according to claim 1, wherein the spacing between the respective inlet pulleys is sufficiently large that incoming continuous paper tubing will not be squeezed between them.

3. A dual belt conveyor according to claim 2, including a braking element, below the inlet pulley of the upper belt for supporting the tubing, the braking element being movable toward and away from the inlet pulley of the upper belt.

4. A dual belt conveyor according to claim 3, wherein the braking element comprises a pivoted sheet metal element.

5. A dual belt conveyor as claimed in claim 4, including eccentric cam means for moving the braking element toward and away from the inlet pulley of the upper belt.

6. A dual belt conveyor according to claim 3, wherein the braking element comprises a sheet metal element.

7. A dual belt conveyor according to claim 3, including means for vertically moving the inlet pulley of the upper belt so as to adjust the angle of wrap of the tubing on the inlet pulley of the lower belt.

8. A dual belt conveyor according to claim 1, including means for moving the upper conveyor belt at a higher speed than the lower conveyor belt.

* * * * *